US005664538A

United States Patent [19]

Hutchins

[11] Patent Number: 5,664,538

[45] Date of Patent: Sep. 9, 1997

[54] BLOCK STRUCTURE FOR AN INTERNAL COMBUSTION ENGINE

[75] Inventor: William Richard Hutchins, Kenilworth, England

[73] Assignee: Rover Group Limited, Birmingham, England

[21] Appl. No.: 575,726

[22] Filed: Dec. 18, 1995

[30] Foreign Application Priority Data

Dec. 20, 1994 [GB] United Kingdom ..... 9425718

[51] Int. Cl.[6] ..... F02B 75/18

[52] U.S. Cl. ..... 123/195 R

[58] Field of Search ..... 123/195 R, 41.74, 123/193.2

[56] References Cited

U.S. PATENT DOCUMENTS

| | | | |
|---|---|---|---|
| 3,183,794 | 5/1965 | Hind | 123/195 R |
| 4,587,933 | 5/1986 | Shaw | 123/41.67 |
| 4,712,517 | 12/1987 | Anno et al. | 123/41.74 |
| 5,190,003 | 3/1993 | Voigt | 123/195 R |
| 5,253,615 | 10/1993 | Heater et al. | 123/195 R |
| 5,501,189 | 3/1996 | Van Bezeij | 123/195 R |

FOREIGN PATENT DOCUMENTS

| | | |
|---|---|---|
| 0 368 478 A1 | 5/1990 | European Pat. Off. . |
| 0 628 716 A1 | 12/1994 | European Pat. Off. . |
| 2 099 075 | 12/1982 | United Kingdom . |
| 2 201 197 A | 8/1988 | United Kingdom . |

*Primary Examiner*—David A Okonsky
*Attorney, Agent, or Firm*—Davis and Bujold

[57] ABSTRACT

An internal combustion engine 20 comprises a cylinder block 22, a cylinder head 24, and a plurality of fasteners 47 holding the head onto the block. The block comprises a single structure having walls 34 defining four cylinder bores 36 arranged in a line for receiving pistons, longitudinal support sections 60, 61 extending along the block one on either side of the line of bores and transverse support sections 74 joined to the longitudinal support sections and extending substantially tangentially to the bores. The fasteners 47 are arranged to engage with the block 22 such that a substantial part of the load exerted on the top of the walls 36 of the bores is transmitted to the fasteners via the support sections. This prevents forces from being transmitted radially into the cylinder walls 36 and thereby reduces bore distortion.

11 Claims, 6 Drawing Sheets

BLOCK STRUCTURE FOR AN INTERNAL COMBUSTION ENGINE

FIELD OF THE INVENTION

The present invention relates to internal combustion engines and is particularly useful in diesel engines.

BACKGROUND OF THE INVENTION

It is known to make cylinder blocks for internal combustion engines from a single casting which has cylinder walls defining a line of cylinder bores and an outer structure which surrounds the cylinder walls and has passages in it for breathing and oil drainage. A space between the cylinder walls and the outer wall structure provides a water jacket having water circulating through it too cool the engine. The cylinder head, usually another casting, is attached to the block by means of a number of fasteners which engage With the block, usually by means of is threads, in the outer wall structure.

Because of the very high pressures produced in the cylinders during combustion, particularly in diesel engines but also in petrol or other internal combustion engines, the force required to hold the head and block together can be very high, reaching about 5 tons per bolt. Analysis of the distribution of pressure in cylinder head gaskets shows that the pressure tends to be greatest around the top of the cylinder walls.

It has been recognized that the cylinder head fasteners tend to distort the cylinder walls, and various block designs have been used to try to overcome this problem. For example GB 2 099 075 describes the provision of an annular flange around each cylinder into which the cylinder head fasteners are threaded. The flange is low down the cylinder so that the region of the cylinder above it is relatively free of distortion. However the clamping forces in the bolts will still be transmitted radially into the bottom of the cylinders causing some distortion even above the flange. U.S. Pat. No. 4,587,933 attempts to solve the problem by distributing the cylinder head bolts evenly about each cylinder and by supporting the base of the cylinders with transverse struts.

The present invention aims to reduce bore distortion by taking an approach which is different to those described in the prior art.

In order to help understanding of the invention, one of the reasons for bore distortion will first be explained more fully with reference to FIG. 1, in which the effect of the high forces in some known blocks is shown schematically. The load path between the fasteners 10 and the cylinder walls 12 is redial and the upward force on the fasteners 10 and the downward force on the cylinder walls 12 result in a moment in the block structure as shown by the arrows 14 which tends to push the cylinder walls 12 inwards near the top of the fastener threads 16, and pull them outwards near the bottom of the fastener threads. This causes distortion of the cylinder bores and results in poor sealing between the piston rings and the bores, which in turn causes an increase in undesirable emissions from the engine.

SUMMARY OF THE INVENTION

The present invention aims to overcome this problem by at least partly preventing the radial transmission of forces into the cylinder walls. This can be achieved using an arrangement shown schematically in FIG. 2. If the block is designed so that the forces between the cylinder walls and the fasteners are transmitted tangentially of the bores, then the radial forces causing bore distortion are reduced.

Accordingly the present invention provides an internal combustion engine comprising a cylinder block, a cylinder head, and a plurality of fasteners tightenable to apply a load to the head to hold it onto the block, wherein the block comprises a single structure having: walls defining a plurality of bores arranged in a line for receiving pistons, said walls being arranged to receive part of said load from he head; and a support structure comprising transverse support sections extending across the block between the bores, wherein the support structure further comprises longitudinal support sections extending along the block one on either side of the line of bores and the block includes joining regions where the longitudinal support sections are joined to the transverse support sections, and the fasteners include engaging means arranged to engage with the block such that a substantial part of the load received by the walls of the bores from the head is transmitted to the fasteners via the joining regions.

In this arrangement the support structure can transmit the forces tangentially of the bores as required by ensuring that, to a substantial extent, the forces from the fasteners is resolved into a longitudinal component transmitted through the longitudinal support sections and a transverse component transmitted through the transverse support sections.

Preferably the part of the block engaged by at least one of the fasteners, which may include engaging means such as threads for engagement with the fastener, is connected to one of the joining regions by a connecting portion of the block, which preferably forms part of a wall of part of an oil drainage cavity in the block.

Preferably said part of said cavity extends beneath the part of the block engaged by said at least one fastener.

Preferably either one or both of the longitudinal support sections and the transverse support sections are approximately level with the lower ends of the bores. This reduces the forces transmitted radially into the cylinder walls through the top deck of the block.

The transverse and longitudinal support sections may be at substantially the same level and joined directly to each other. In this case the joining regions will be at the points where the support sections meet.

Alternatively the transverse and longitudinal support sections may be at different levels, but joined by interconnecting sections of the block so that they form an effectively unitary support structure. In this case the joining regions will include the interconnecting sections.

Preferably the fasteners engage the block at a position substantially lower than the top of the bores. This also reduces the forces transmitted radially into the cylinder walls through the top deck of the block.

Conveniently at least one of the longitudinal support sections extends parallel to an oil gallery in the engine block, between the oil gallery and the bores, and it may form part of a wall of the oil gallery.

At least one of the transverse support sections can conveniently comprise part of a lateral bulkhead which extends across a crankcase region of the block.

DESCRIPTION OF THE PREFERRED EMBODIMENTS

Figure 3:
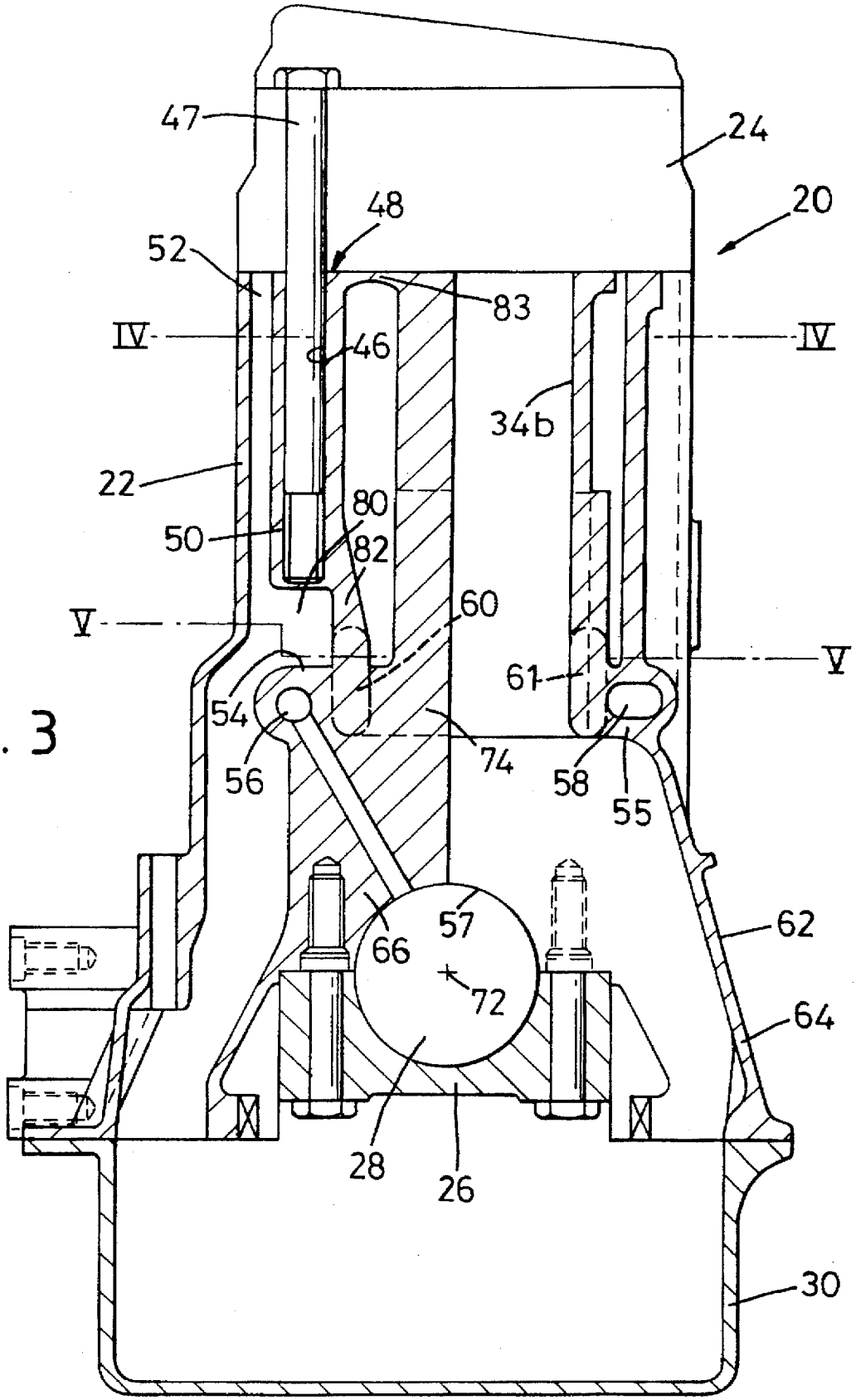
FIG. 3 is a transverse section through an engine according to a first embodiment of the invention.

Referring to FIG. 3 an internal combustion engine 20 comprises a cast iron cylinder block 22, an aluminium cylinder head 24, a bearing ladder 26, a crankshaft 28 and a sump 30. The cylinder block 22 is formed as a single iron casting and includes cylinder walls 34*a*, 34*b* 34*c* 34*d* which define the bores 36*a* 36*b* 36*c* 36*d* in which the pistons (not shown) travel, and an outer wall structure 38. Between the cylinder walls 34 and the outer wall structure 38 is a water jacket 40 which is a space which can be filled with water and which separates the cylinder walls 34 from the outer wall structure 38 over most of the height of the cylinders.

The cylinder walls 34 are formed as four parallel hollow cylinders 42 each being joined to the one(s) next to it down a line parallel to their axes 44.

The outer wall structure 38 has ten bores 46 for receiving the steel fasteners 47 which attach the head 24 to the block 22. These bores 46 extend vertically down through the block 22 from its upper surface 48 to a point about two thirds of the way down the cylinder bores 36, and are threaded at their lower ends 50. They are arranged in two rows of five bores, one on either side of the cylinder bores 36, and are aligned with the joins 49 between the cylinder walls 34 or the outer edge of the walls 34*a* 34*d* of the end cylinders. Oil drainage passages 52 extend down through the block 22 on the outside of the fastener bores 46 from the upper surface 48 of the block down to the sump 30. The walls 53 which surround the fastener bores 46 and separate them from the oil drainage passages 52 are relatively thin and the fasteners are therefore in good thermal contact with the oil drainage passages. This helps to ensure that, when he engine is warming up, the fasteners are heated by the oil in the drainage passages 52 and tend to heat up and expand faster than the block 22. This helps them to accommodate the relatively rapid expansion of the aluminium head 24. Also the whole of the length of the fasteners above the threads is free to stretch to accommodate the expansion of the aluminium head 24.

The water jacket 40 stops slightly above the level of bottom of the cylinder bores 36. On either side of the cylinder bores 36, between the bottom of the water jacket 40 and the bottom of the cylinder bores 36 is section 54, 55 of the block 22 which runs along substantially the full length of the block. At the outer edge of one of these sections 54 is a passageway 56 in the form of a drilled oil gallery for supplying oil to the crankshaft bearings 57, and at the outer edge of the other 55 is another passageway 58 which is part of the oil drainage and breather system and is formed during the casting of thee block. Just inside these passageways 56, 58 a solid section 60, 61 of metal extends straight through the block over substantially its whole length. These solid sections 60, 61 form longitudinal support sections, the function of which will be described below.

Below the bottom of the cylinder bores 36 the block 22 forms the upper part of the crankcase 62 of the engine. This comprises an outer wall partly defining the crankcase, with lateral bulkheads 66 which extend across the crankcase dividing it into four bays 68, one below each cylinder bore 36. The lateral bulkheads 66 also form the upper half of the crankshaft bearings 57, the lower half of which is formed by the bearing ladder 26. They are solid so that the bays 68 are completely separated above the centre line 72 of the crankshaft 28. The lateral bulkheads extend upwards between the bottom part of the cylinder bores 36 and thereby form transverse support sections 74 which extend across the block 22 between the longitudinal support sections 60, 61.

Figure 5:
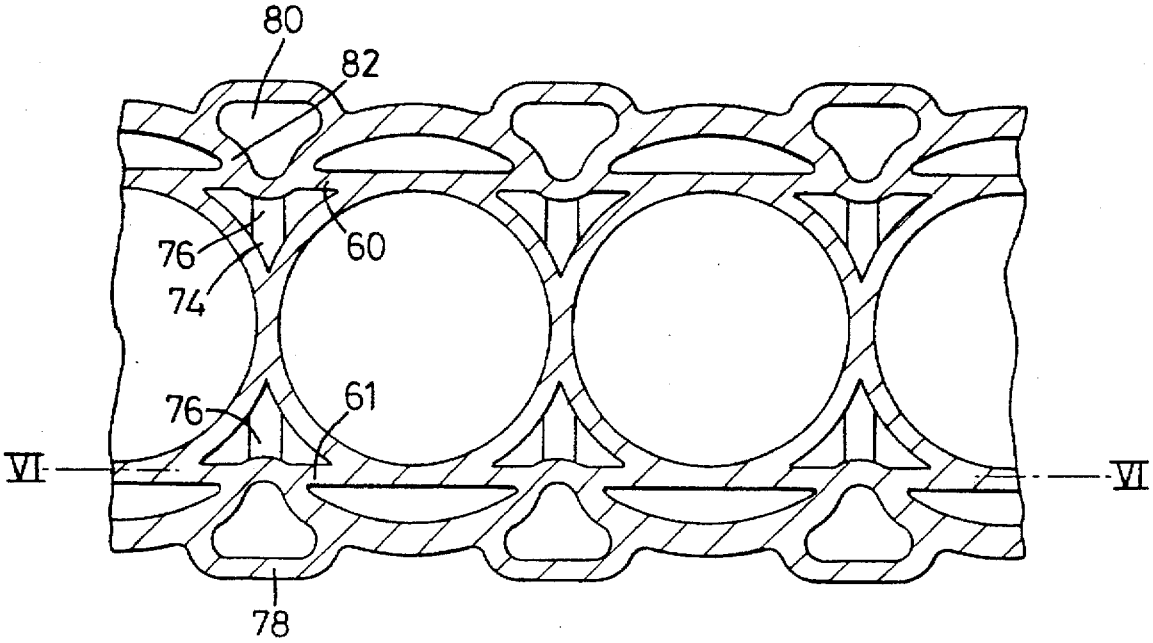
FIG. 5 is a horizontal section on line V—V of FIG. 3.

As can best be seen in FIG. 5 the longitudinal and transverse support sections 60, 61, 74 are mutually perpendicular, are all perpendicular to the axes 44 of the cylinders, and all run tangentially to the cylinder bores 36 and are joined to the cylinder walls 34. In fact, in the embodiment shown, they run into and form part of the cylinder walls 34 at their lower ends. They are also joined to each other, at joining regions one at each end of each transverse support section, and form a unitary grid-like support structure.

Figure 4:
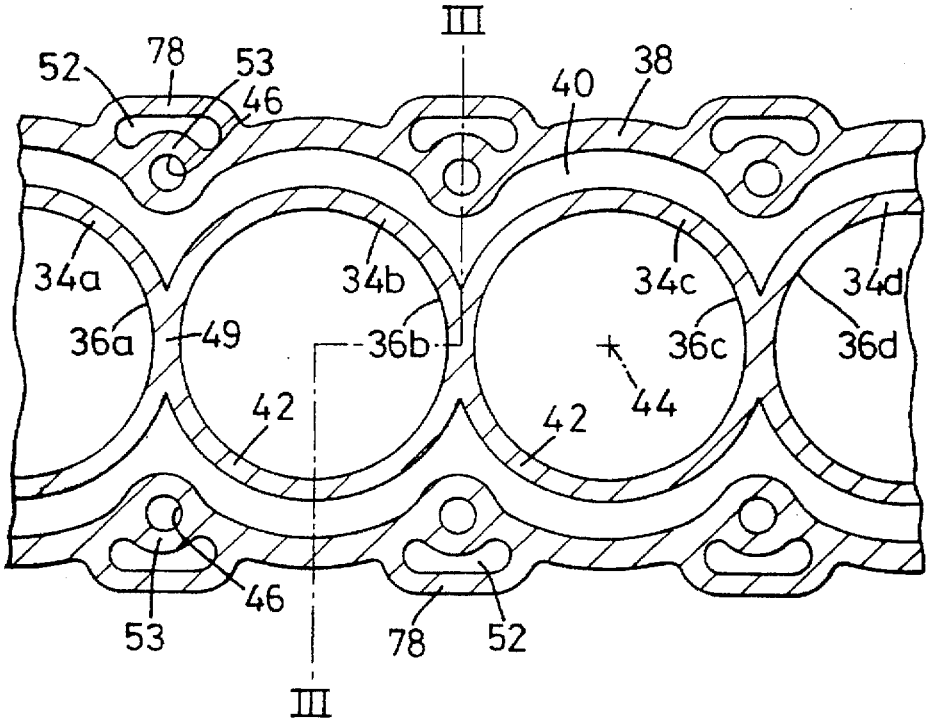
FIG. 4 is a horizontal section on line IV—IV of FIG. 3.

As can be seen in FIG. 3, the threaded lower ends 50 of the fastener bores 46 are each situated above one of the joining regions where the ends 76 of the transverse support sections 74 are joined to the longitudinal support sections. However the outer walls 78 of the oil drainage passages 52 extend vertically downwards below the lower ends 50 of the fastener bores 46, and the oil drainage passages 52 widen out to form a chamber 80 which extends directly below the lower ends 50 of the fastener bores The result of this is that a vertical column 82, formed at its upper end by the outer wall 78 of the oil drainage passage 52 and part of the wall 53 of the fastener bore 46 (see FIG. 4) and at its lower end by the wall 88 of the chamber 80 (see FIG. 5), provides a strong interconnection between the threaded lower end 50 of each of the fastener bores 46 and the longitudinal and transverse support sections 60, 61, 74 at their point of intersection.

Figure 6:
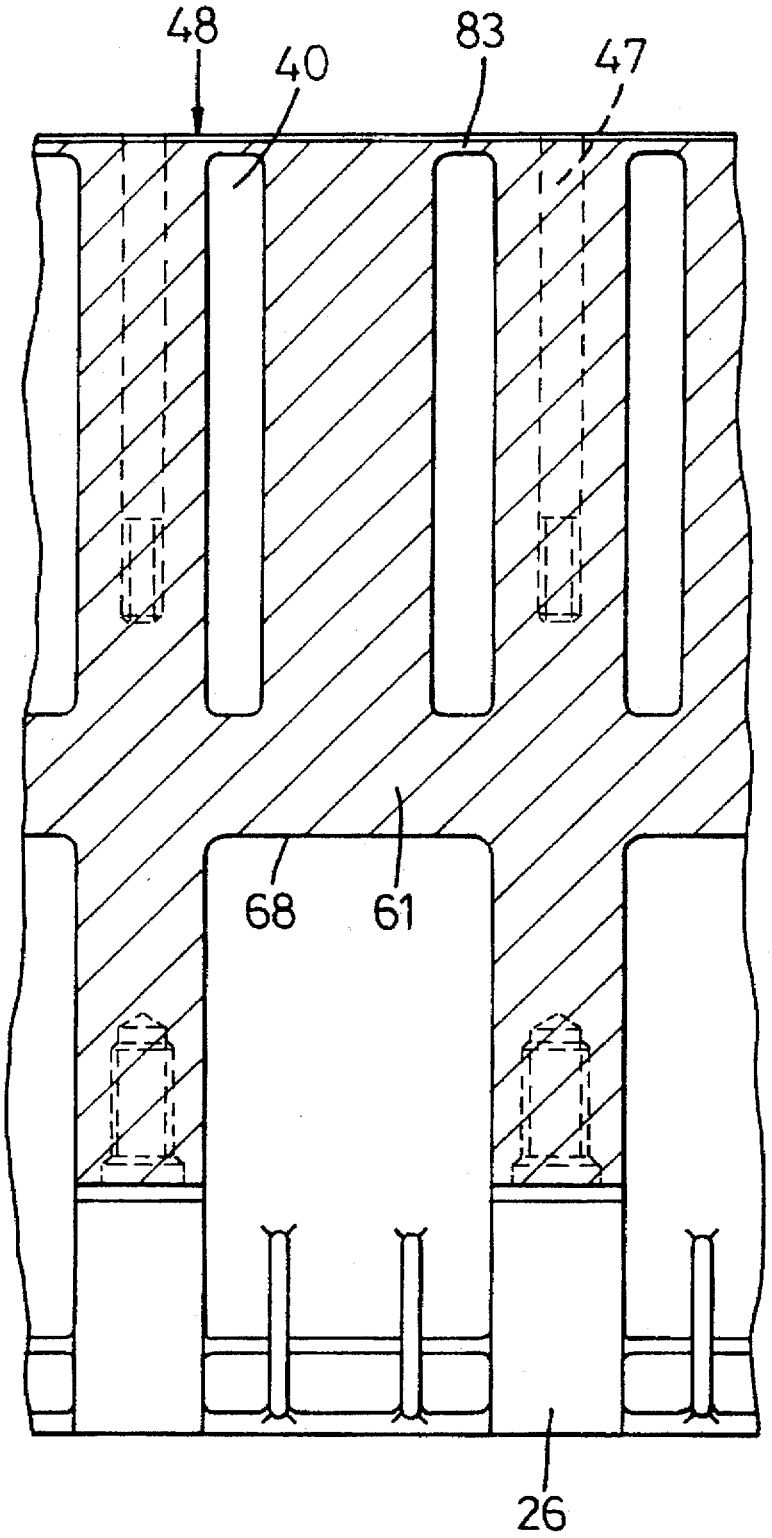
FIG. 6 is a longitudinal section on line VI—VI of FIG. 4.
Figure 7:
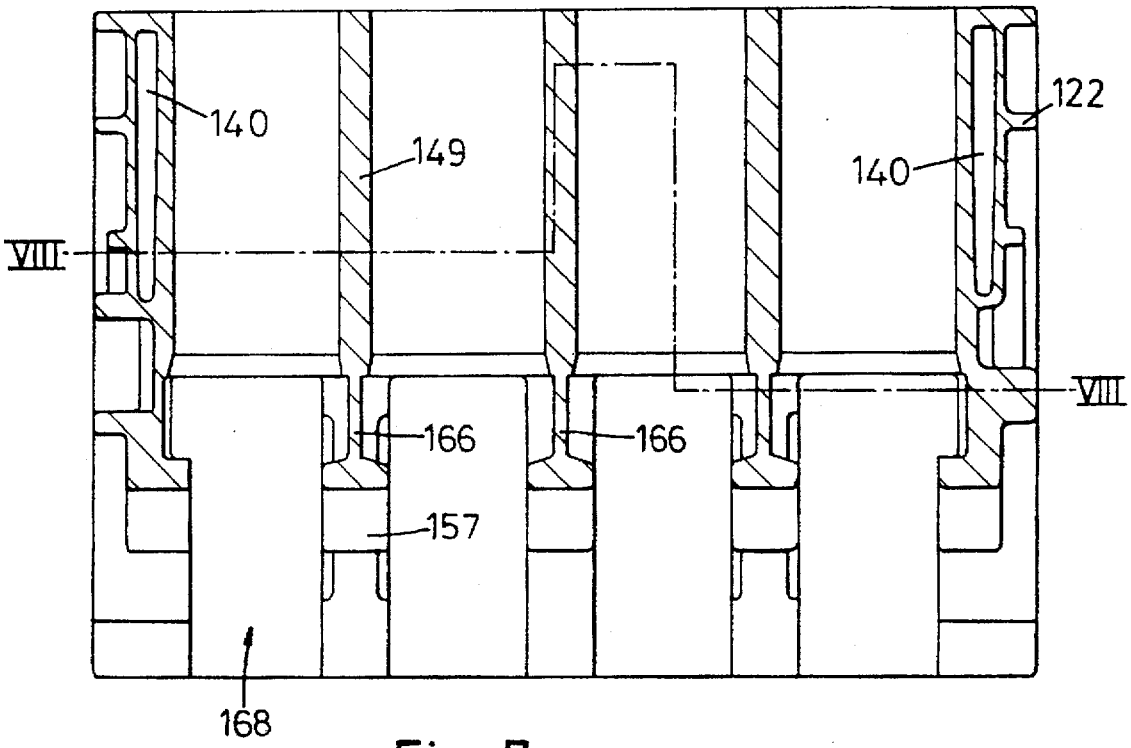
FIG. 7 is a longitudinal section through the block of an engine according to a second embodiment of the invention.
Figure 8:
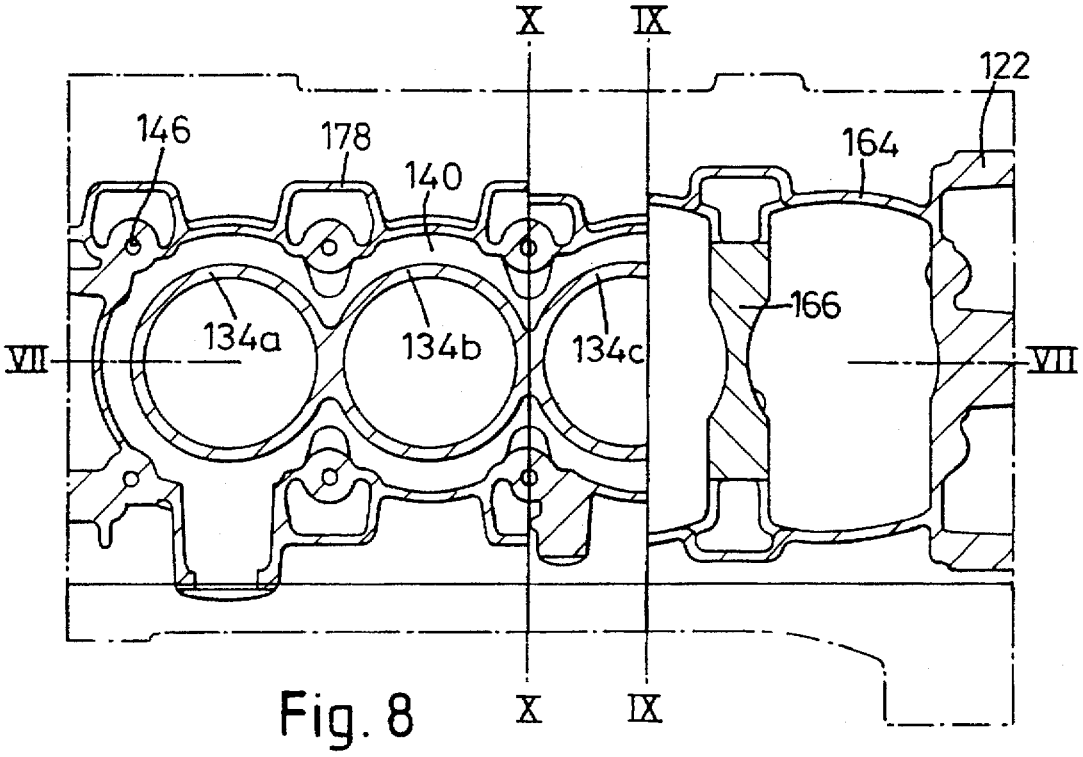
FIG. 8 is a horizontal section on line VIII—VIII of FIG. 7.
Figure 9:
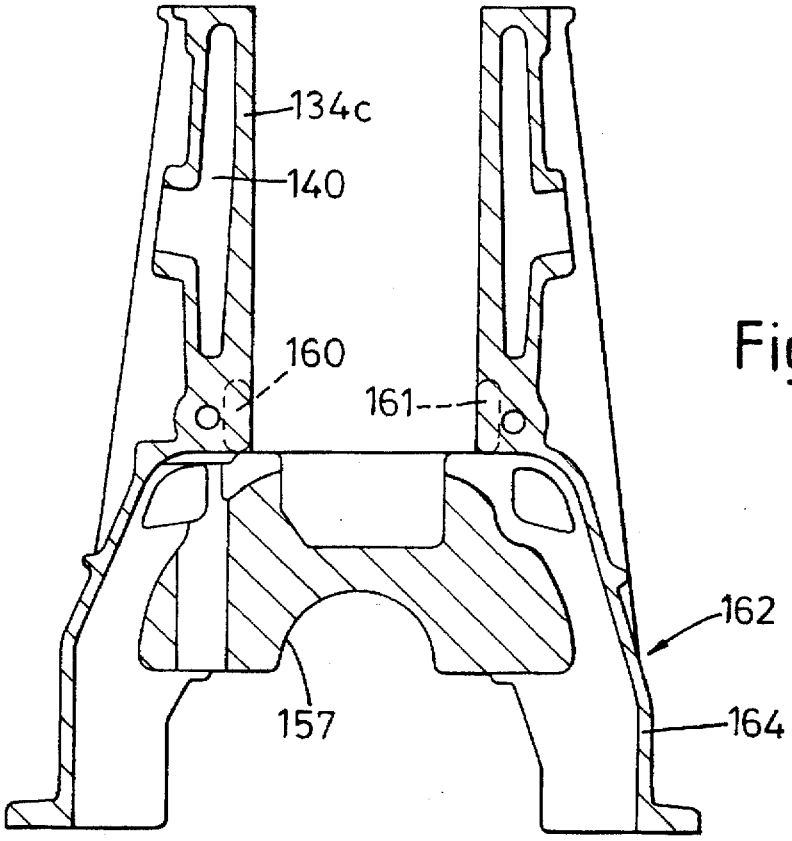
FIG. 9 is a transverse section on line IX—IX of FIG. 8.
Figure 10:
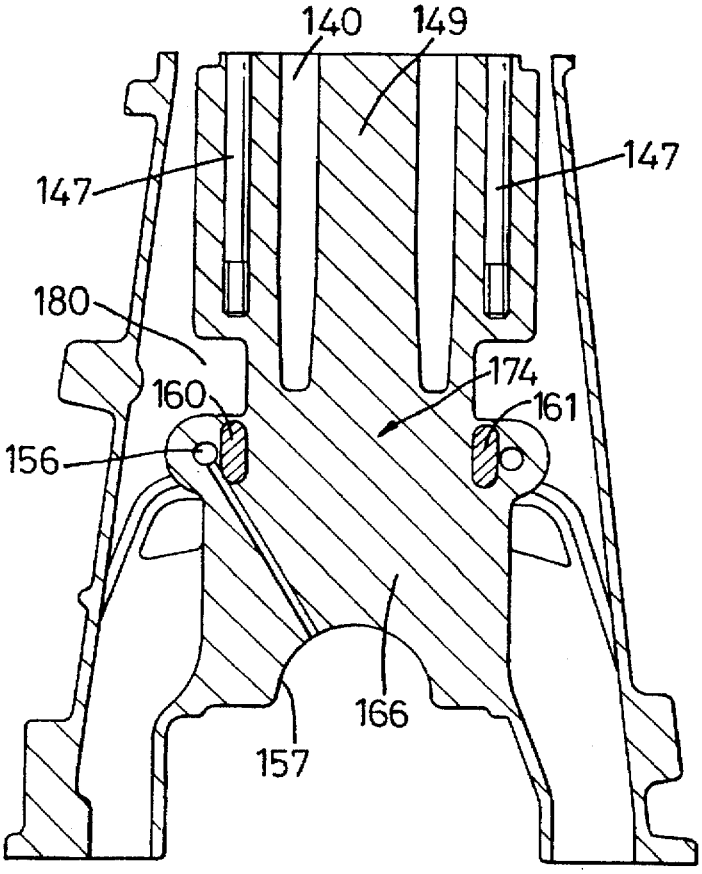
FIG. 10 is a transverse section on line X—X of FIG.

As can be seen in FIG. 6, a large part of the upper surface 48 of the block is covered over by a relatively thin layer of metal 83 which seals the water jacket 40. However the stiffness of the top of the block caused by this layer is less than the stiffness at the level of the of the longitudinal and transverse support sections 60, 61, 74. Because of this forces tend to be transmitted between the fasteners and the cylinder walls 34 through the support sections rather than through the top of the block.

Figure 1:
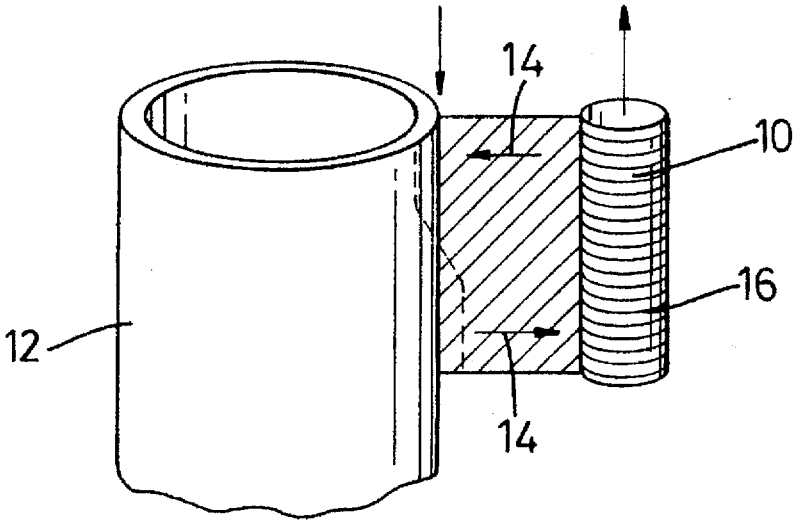
FIG. 1 and FIG. 2 show diagramatically the principles on which the invention is based as described above.
Figure 2:
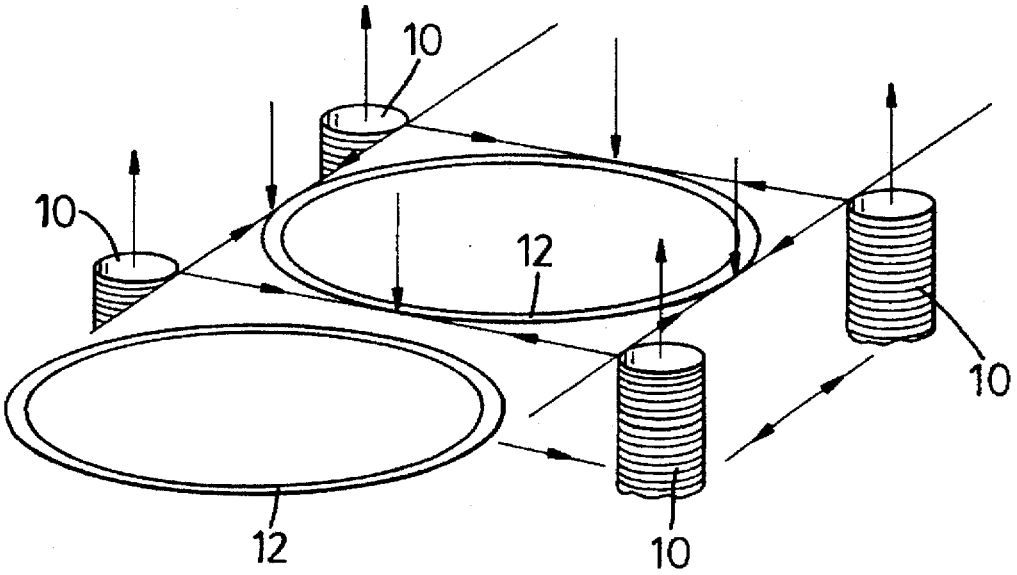

The loads applied by the tightening of the fasteners 47 to clamp the head 24 to the block 22 are transmitted through the block substantially as shown in FIG. 2. The fasteners 47 are in tension and the head 24 and block 22 are in compression. The downward pressure exerted by the head 24 on the top of the cylinder walls 34 is transmitted vertically downwards into the longitudinal and transverse support sections 60, 61, 74 where they are joined to the cylinder walls 34. The upward force applied to the block by the threads of the fasteners 47 is transmitted via the columns 82 into the longitudinal and transverse support sections 60, 61, 74 where they are joined to each other. The moments resulting from the non-alignment of these forces are contained within the support sections 60, 61, 74 and are tangential to the bores 36. They therefore tend to cause significantly less bore distortion than is found in known block structures.

The second embodiment of the invention; the cylinder block of which is shown in FIGS. 7 to 10 is similar to the first embodiment, and corresponding features are indicated by the same reference numerals preceded by a 1.

It will be appreciated that, because the block is formed as a single casting its various features could be positioned in positions different from those shown. For example the support sections 60, 61, 74 could be situated higher up the block, or could be at different levels to each other, and the threaded ends 50 of the fastener bores could be level with the support sections or higher up than shown. The important requirement is that the block includes a stiff structure between the threaded ends 50 of the fastener bores and the support sections 60, 61, 74, and that any structure connecting radially between the threaded ends 50 of the fastener bores and the cylinder walls 34 is relatively flexible.

The embodiments described above are vertically arranged in-line engines with the head at the top of the block and the crankcase at the bottom. It will be appreciated that the invention is also applicable to V-configurations of engines and flat engines in which the head and crankcase will still be at first and second opposite ends of the block, but not necessarily the top and the bottom. Therefore where necessary in this specification, references to the top and bottom of the block should be construed as references to the head end and crank end respectively, and references to the directions up and down should be construed as meaning towards those ends accordingly.

What is claimed is:

1. An internal combustion engine comprising a cylinder block, a cylinder head, and a plurality of fasteners tightenable to apply a load to the head to hold the head onto the block, wherein the block comprises a single structure having: walls defining a plurality of bores arranged in a line for receiving pistons, said walls being arranged to receive part of said load from the head; and a support structure comprising transverse support sections extending across the block between the bores, the support structure further comprises longitudinal support sections extending along the block one on either side of the line of bores substantially tangentially to the bores which are joined to said walls so as to provide support for said bores, and the block includes joining regions where the longitudinal support sections are joined to the transverse support sections, and the fasteners include engaging means arranged to engage with the block such that a substantial part of the load received by the walls of the bores from the head is transmitted to the fasteners via the joining regions.

2. An engine according to claim 1 wherein the longitudinal support sections are substantially tangential to the bores.

3. An engine according to claim 1 wherein the transverse support sections are substantially tangential to the bores.

4. An engine according to claim 1 wherein the block includes a part engaged by at least one of the fasteners which part is connected to one of the joining regions by a connecting portion of the block.

5. An engine according to claim 4 wherein the block includes a wall defining part of an oil drainage cavity and the connecting portion forms part of said wall.

6. An engine according to claim 5 wherein said part of said cavity extends beneath the part of the block engaged by said at least one fastener.

7. An engine according to claim 1 wherein the bores have lower ends with which the longitudinal support sections are approximately level.

8. An engine according to claim 1 wherein the bores have lower ends with which the transverse support sections are approximately level.

9. An engine according to claim 1 wherein the transverse and longitudinal support sections are at substantially the same level and are joined directly to each other.

10. An engine according to claim 1 wherein the block includes a part defining an oil gallery and at least one of the longitudinal support sections extends parallel to the oil gallery between the oil gallery and the bores.

11. An engine according to claim 1 wherein the block includes a lateral bulkhead which extends across a crankcase region of the block and at least one of the transverse support sections comprises part of the lateral bulkhead.

* * * * *